US008011449B2

(12) United States Patent
Roth et al.

(10) Patent No.: US 8,011,449 B2
(45) Date of Patent: Sep. 6, 2011

(54) METHOD AND APPARATUS FOR DIRECTIONAL DRILLING

(76) Inventors: Raymond G. Roth, Gadshill (CA); Rodger Laking, Simcoe (CA)

( * ) Notice: Subject to any disclaimer, the term of this patent is extended or adjusted under 35 U.S.C. 154(b) by 162 days.

(21) Appl. No.: 10/596,260

(22) PCT Filed: Dec. 11, 2003

(86) PCT No.: PCT/CA03/01921

§ 371 (c)(1),
(2), (4) Date: Feb. 6, 2007

(87) PCT Pub. No.: WO2005/056971

PCT Pub. Date: Jun. 23, 2005

(65) Prior Publication Data

US 2007/0158111 A1 Jul. 12, 2007

(51) Int. Cl.
*E21B 7/28* (2006.01)

(52) U.S. Cl. ..... 175/53

(58) Field of Classification Search ..... 175/53, 175/62, 385, 390

See application file for complete search history.

(56) References Cited

U.S. PATENT DOCUMENTS

| | | | | | |
|---|---|---|---|---|---|
| 2,998,397 | A | * | 8/1961 | Riesing | 524/32 |
| 3,083,765 | A | * | 4/1963 | Kammerer | 166/290 |
| 3,894,402 | A | | 7/1975 | Cherrington | |
| 4,509,607 | A | * | 4/1985 | Saxman et al. | 175/227 |
| RE32,267 | E | * | 10/1986 | Cherrington | 175/53 |
| 4,673,312 | A | * | 6/1987 | Nussbaumer | 405/184 |
| 4,754,526 | A | * | 7/1988 | Tremoulet et al. | 175/424 |
| 5,628,585 | A | | 5/1997 | Parish, II et al. | |
| 5,687,805 | A | * | 11/1997 | Perry | 175/53 |
| 5,687,807 | A | | 11/1997 | Woods et al. | |
| 5,735,360 | A | * | 4/1998 | Engstrom | 175/391 |
| 6,082,471 | A | | 7/2000 | Osadchuk | |
| 6,708,786 | B2 | * | 3/2004 | Cariveau et al. | 175/371 |
| 7,243,737 | B2 | * | 7/2007 | Michael | 175/53 |

FOREIGN PATENT DOCUMENTS

WO 0175261 10/2001

* cited by examiner

*Primary Examiner* — Daniel P Stephenson

(74) *Attorney, Agent, or Firm* — Borden Ladner Gervais LLP; Jeffrey W. Wong

(57) ABSTRACT

The present invention is directed at a pullhead/reamer for use in digging a hole in the ground; comprising a first end (22) shaped to receive a mandrel struts, connecting the first end to the second end, the struts defining a set of open flutes (48) therewithin; and a set of slurry jets (50); wherein when the pullhead/reamer is in use, the set of slurry jets release a pressurized liquid to mix with the ground producing a slurry which enters the pullhead/reamer via the open flutes.

5 Claims, 9 Drawing Sheets

METHOD AND APPARATUS FOR DIRECTIONAL DRILLING

TECHNICAL FIELD

The present invention is directed at directional drilling and, more specifically, at a method and apparatus for use in directional drilling.

BACKGROUND OF THE INVENTION

In the past, in order to lay down underground pipelines, trenches were dug and the pipes were placed in the bottom of the trenches. After the pipes had been leveled, the trenches were generally re-filled with the ground that had been previously dug up.

However, more recently, directional drilling has been used to drill holes underground to assist in the laying down of pipelines and other utilities so that less work is required to re-fill trenches.

In directional drilling, a large hole is initially dug out to align with the depth that the pipe is to be installed so that the directional drilling apparatus may be assembled. Prior to operation, a motor is connected to a mandrel which is used to create a guide line along which the pipe is to be laid down. The motor causes the mandrel to rotate creating a small hole. The directional drilling apparatus may further comprise means for aligning the mandrel and for constantly watching the digging of the guide line. The drilling of the guide line results in a small hole being created from the location of the motor to the large hole. After the mandrel reaches the large hole, a reamer is connected to the mandrel along with the pipe that is to be laid down. The motor is once again enabled to rotate the mandrel and to draw the mandrel, reamer and pipe. This requires a number of increasingly larger passes at which time the reamer and pipe are pulled towards the motor. The rotation of the motor causes the size of the guide line hole to increase allowing the pipe to be laid down.

During the hole producing process, liquid, in the form of bentonite or other drilling fluid is released via jets in the drilling apparatus. The bentonite mixes with the ground to create a slurry which is passed backwards against the surface of the pipe to the large hole. In order to provide space for the slurry to travel, the circumference of the reamer is generally one and half times larger than the circumference of the pipe. This extra space allows the slurry to travel towards the hole but also allows for frac-outs to occur. A frac-out is the uncontrolled spilling of drilling fluids, usually bentonite, into the environment. This happens when the hole being drilled fractures or collapses and the fluids that are used to lubricate the drill seep out of the hole. Frac-outs can be devastating to the environment.

DISCLOSURE OF THE INVENTION

It is an object of the present invention to obviate or mitigate at least one disadvantage of previous methods and apparatus for directional drilling.

In a first aspect, the present invention provides a pullhead/reamer for use in digging a hole in the ground; comprising a first end shaped to receive a mandrel; a second end shaped to fit around an end of a pipe; a set of struts, connecting the first end to the second end, the struts defining a set of open flutes therewithin; and a set of slurry jets; wherein when the pullhead/reamer is in use, the set of slurry jets release a pressurized liquid to mix with the ground producing a slurry which enters the pullhead/reamer via the open flutes.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

BEST MODE FOR CARRYING OUT THE INVENTION

Figure 1A:
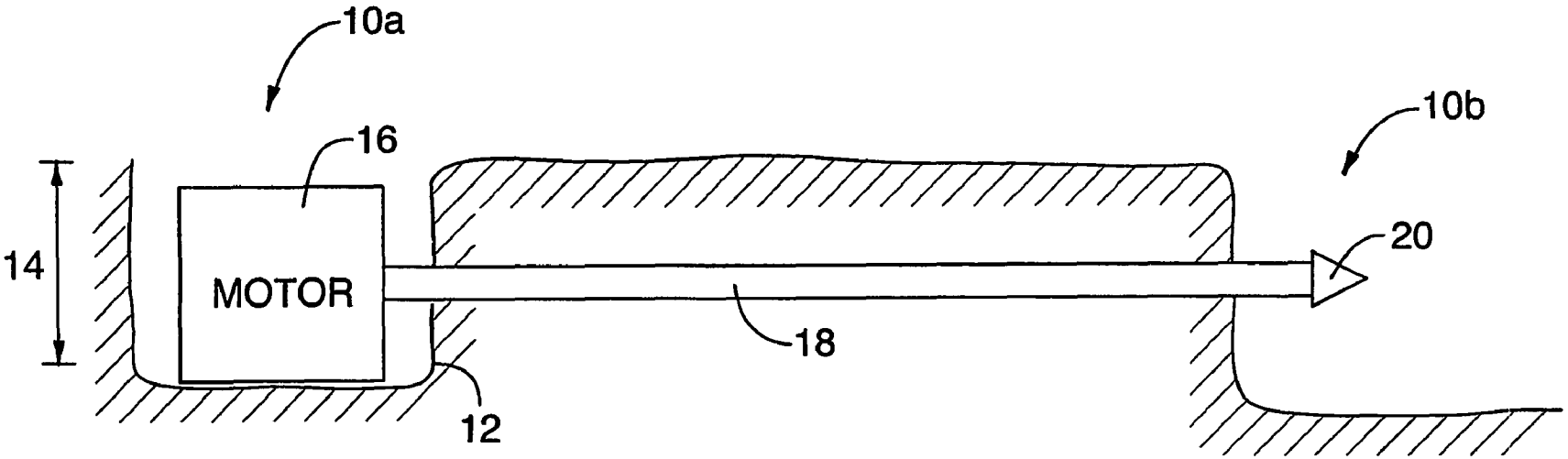
FIG.1A (Prior Art)
FIG. 1*a* is a schematic diagram of prior art pilot hole drilling apparatus.

Turning to FIG. 1*a*, a schematic diagram of prior art directional drilling apparatus for producing a pilot/guide hole (after the pilot hole has been dug) is shown. In this pilot hole drilling apparatus, two large holes 10*a* and 10*b* are initially dug out of the ground with its bottom edge 12 located below a depth 14 for a pipe to be installed. Once the first hole 10*a* is dug, a motor 16 is placed in the hole 10*a* and connected to one end of a mandrel 18 which has a drill bit 20 connected at its other end. The mandrel 18 is preferably hollow so that drilling liquid may be passed from the first hole 10*a* to the second hole 10*b* during the pipe hole drilling process. The drill bit 20 is preferably attached to the mandrel 18 via a screw fitting so that the drill bit 20 may be screwed on and unscrewed off when necessary as will be described below.

After the second hole 10*b* is dug, the motor 16 is started in order to rotate the mandrel 18 and the drill bit 20. The drill bit 20 then rotates through the ground from the first hole 10*a* to the second hole 10*b* to produce a pilot hole, which is used as a guide for the pipe hole drilling apparatus, from the first hole 10*a* to the second hole 10*b*. After the drill bit reaches the second hole 10*b*, the drill bit 20 is unscrewed so that the pipe hole drilling apparatus may be attached.

Although not shown, the pilot hole directional drilling apparatus may further comprise means for aligning the drill bit during the pilot hole drilling process and means for monitoring the digging of the hole to ensure that the pilot hole drilling apparatus remains aligned.

Figure 1B:
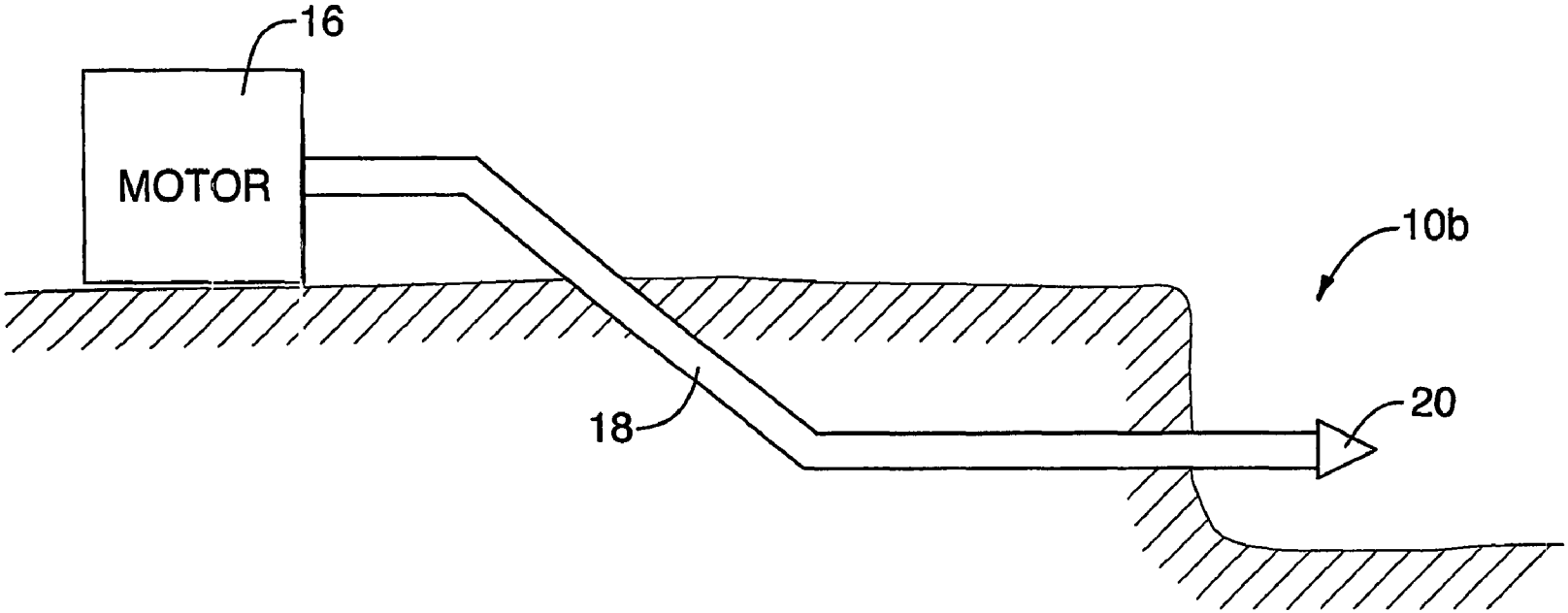
FIG.1B (Prior Art)
FIG. 1*b* is a schematic diagram of a second embodiment of prior art pilot hole drilling apparatus.

Turning to FIG. 1*b*, which shows a second embodiment of prior art pilot hole drilling apparatus, although shown as being located in the first hole 10*a*, the motor 16 may also be located on the ground's surface with the drill bit 20 entering the ground at a diagonal slope before being shifted so that the guide hole being drilled is substantially parallel to the Earth's surface. It will be understood that in this embodiment, the mandrel 18 has a sloped shape which, in combination with existing electrical equipment, may be steered by an experienced operator.

Figure 2:
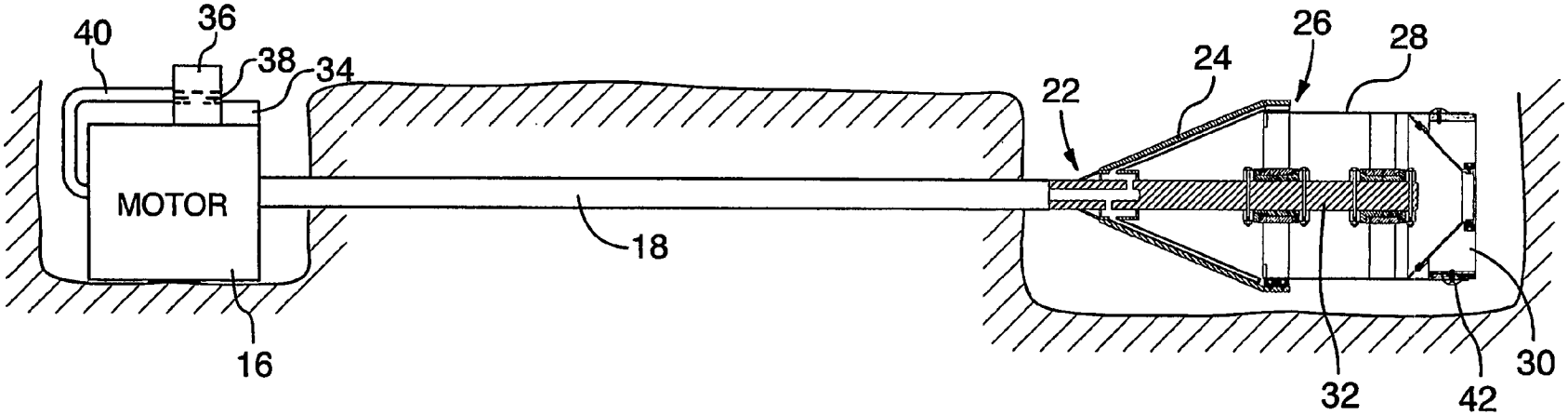
FIG. 2 is a schematic diagram of pullhead/reamer directional drilling apparatus installed in the ground

Turning to FIG. 2, a schematic diagram of pullhead/reamer, or pipe hole, directional drilling apparatus for laying down the pipe is shown. After the drill bit has been unscrewed from the mandrel, a first end 22 of a pullhead/reamer 24 is screwed onto the mandrel 18. A second end 26, seen as a grade ring, of the pullhead/reamer 24 is attached to a steel connect 28 which serves as a connection between the pullhead/reamer 24 and a pipe 30 which is to be installed into a hole produced by the directional drilling process. The pullhead/reamer 24, the steel connect 28 and the pipe 30 are shown in cross-section in FIG. 2.

The steel connect 28 is connected to the mandrel 18 via a bearing assembly 32 which assists in allowing the pullhead/reamer 24 to be rotated by the motor 16 during the pipe hole directional drilling process while reducing or eliminating rotation of the pipe 30 during the same process.

In the first hole 10*a*, or at the location of the motor 16, a pump 34 is located along with a reservoir 36 containing a drilling fluid 38, such as bentonite. The reservoir 36 and the pump 34 are connected to the end of the mandrel, via piping 40 for pumping the bentonite down through the mandrel during the pipe hole directional drilling process.

Furthermore, although not shown, a conventional reamer may be connected to the mandrel 18 in front of the first end 22 of the pullhead/reamer 24 to provide further assistance in drilling the pipe hole with the circumference of the conventional reamer being the same as the circumference of the pullhead/reamer 24. In general, the conventional reamer has a threaded connection which attaches to the mandrel and then to the pullhead/reamer 24.

The pilot/guide hole, substantially a straight line, produced by the mandrel and drill bit serves as an assistance to the pipe hole directional drilling apparatus in aligning the mandrel 18 and the pullhead/reamer 24 so that the hole that is dug by the pipe hole drilling apparatus for placing the straight pipe 30.

After the first end of the pullhead/reamer 24 is attached to the mandrel 18, the steel connect 28 is attached to the mandrel 18 using the bearing assembly 32. The steel connect 28 is then attached to the pipe 30 via a set of fastening means 42, such as a set of screws.

After the pipe 30 has been attached, the motor 16 is once again enabled to rotate the mandrel and the pullhead/reamer and to draw the mandrel 18, pullhead/reamer 24, steel connect 28 and pipe 30 towards the motor 16 along the guide hole. The rotation of the pullhead/reamer (and conventional reamer, if present) along the guide hole causes the size of the pilot hole to increase, from the circumference of the drill bit to the larger circumference of the pullhead/reamer 24, allowing the pipe 30 to be laid down since the pullhead/reamer is both designed to dig through the ground to create holes as described and shown in more detail in FIG. 4.

Figure 3:
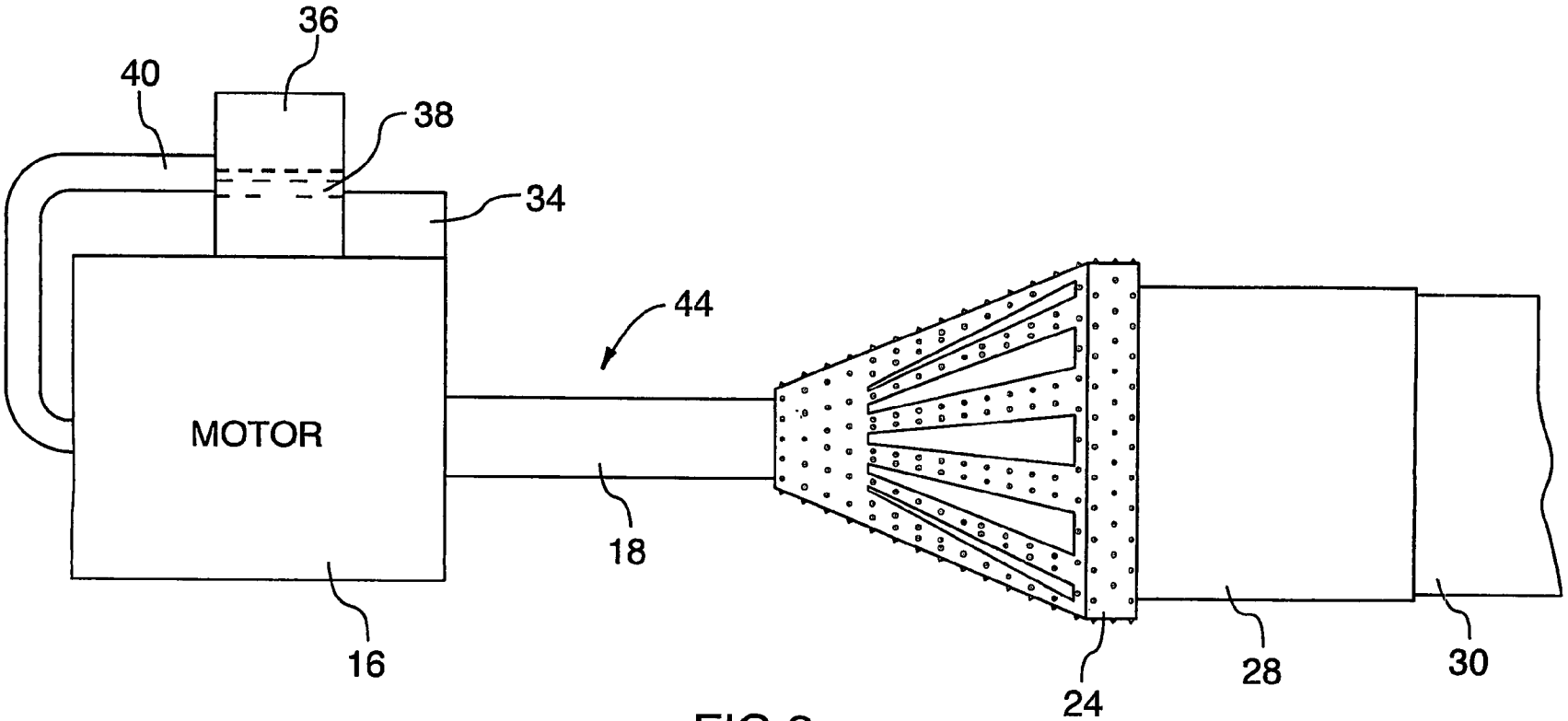
FIG. 3 is a more detailed schematic diagram of the pullhead/reamer directional drilling apparatus of FIG. 2.

Turning to FIG. 3, a more detailed schematic diagram of the pipe hole directional drilling apparatus described above is shown. As will be understood, although not shown, the conventional reamer may be easily slotted over the mandrel 18 between the motor 16 and the pullhead/reamer 24. The motor 16, the mandrel 18 and the pullhead/reamer 24 may be seen as holing means 44.

The second end 26 of the pullhead/reamer 24, which is connected to the pipe 30, via the steel connect 28, comprises an outer circumference which is slightly larger than the outer circumference of the pipe 30 so that the pipe hole drilled by the pullhead/reamer 24 is large enough for the pipe 30 to travel within. Unlike prior art pipe hole drilling apparatus which generally require a reamer which has a circumference which is one and a half times the circumference of the pipe being inserted, there is only a slight difference, of about 2 inches, between the circumferences of the pullhead/reamer 24 of the present invention and the pipe 30. This allows for a smaller hole to be drilled by the holing means 44 and to reduce the chance of a frac-out occurring. Furthermore, the pipe 30 may be installed with little or no obstruction such as the extra ground which is displaced when using only a conventional reamer. It is understood that the selection of the conventional reamer for use with the pullhead/reamer 24 of the present invention is based on the circumference of the pullhead/reamer 24 and not the circumference of the pipe 30 which overcomes some of the disadvantages of prior art directional drilling apparatus.

Figure 4:
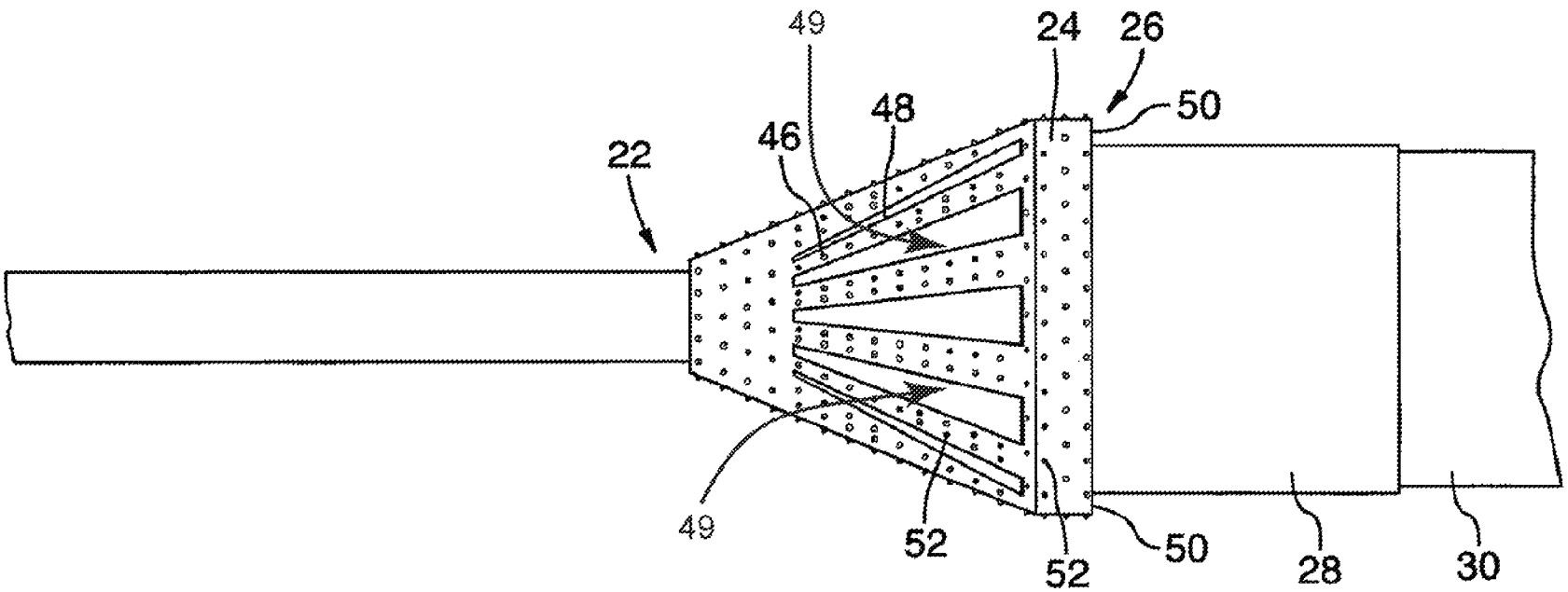
FIG. 4 is a schematic diagram of a pullhead/reamer for use with the present invention.

Turning to FIG. 4, a more detailed schematic of the pullhead/reamer is shown. The pullhead/reamer 24 comprises the first end 22 which includes a mandrel connecting area, having an inner shape matching the outer shape of the mandrel and internal threads so that the pullhead/reamer 24 is screwed on to the mandrel, and the second end 26 which includes a steel connect connecting area, having an inner circumference which is slightly larger than the outer circumference of the steel connect so that the steel connect 28 is slotted into second end 26.

The first end 22 is connected to the second end 26 via a set of integrally formed struts 46. The spacing between each of the struts also defines a set of open flutes or ports 48.

Also located at the second end 26 is a set of slurry producing jets 50 which release a drilling fluid, preferably bentonite, during the pipe hole drilling process to mix with the ground to create a slurry. The slurry producing jets 50 provide almost pure bentonite mixture to lubricate the ground, the surface of the pullhead/reamer 24, the steel connect 28 and the pipe 30 allowing the parts to more easily slide along the newly dug hole.

As further shown in FIG. 4, located on the outer surface of the first end 22, the set of struts 46 and the second end 26 are a set of cutting teeth 52 which assist in the pipe hole directional drilling process to drill the hole in the ground. The teeth 52 provide further support and strength in creating the hole such that when the pullhead/reamer 24 is rotated, there is more friction between the pullhead/reamer 24 and the ground to remove the ground away from the hole.

Figure 5:
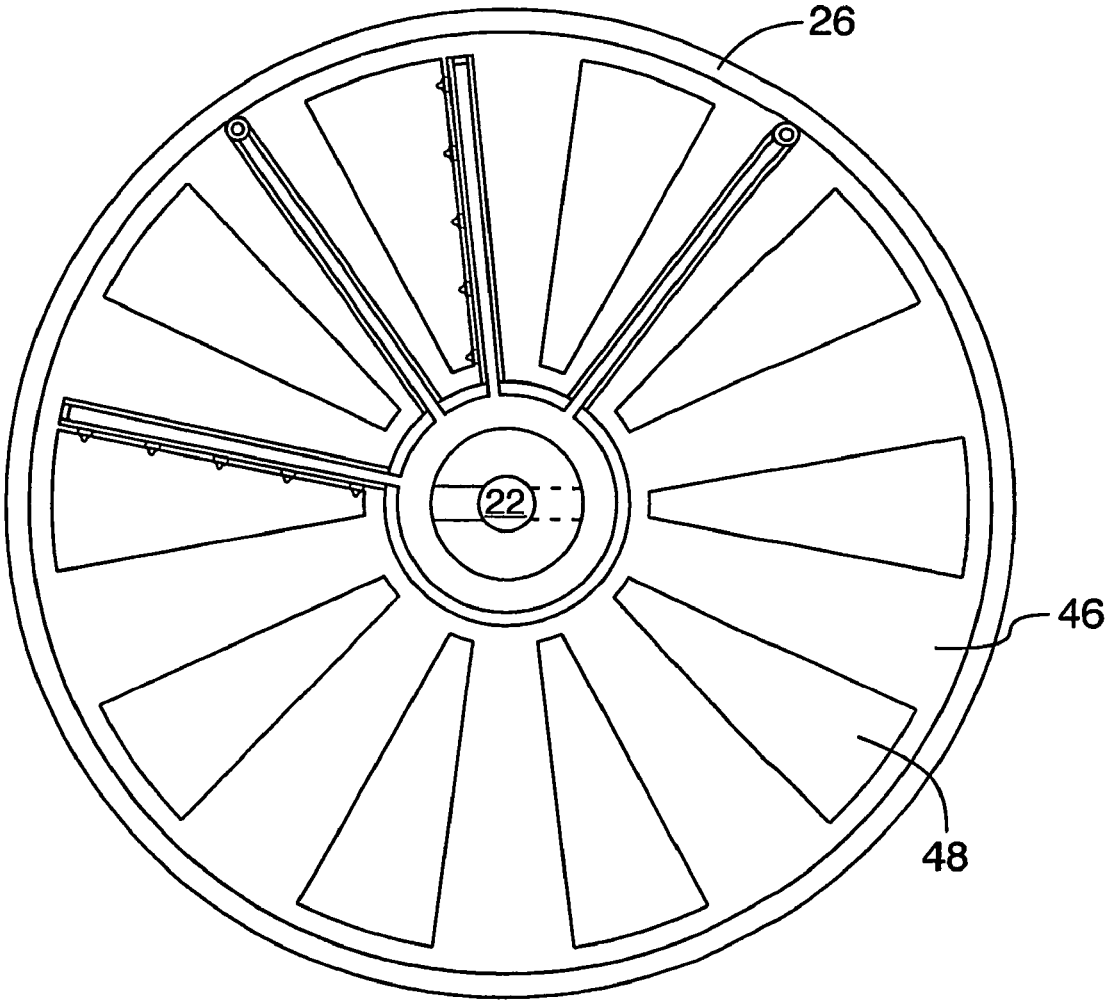
FIG. 5 is a front view of the pullhead/reamer of FIG. 4.

Turning to FIG. 5, a front view of the pullhead/reamer 24 is shown. As can be seen, the first and second ends are both circular with the first end 22 being smaller than the second end 26. As discussed above, the size of the first end is defined by the circumference of the mandrel 18 being used while the size of the second end is defined by the circumference of the pipe 30 being installed. As more clearly seen in this Figure, the set of struts 46 form a spoke-like pattern so that each of the open flutes/ports 48 is evenly defined. It will be understood that the set of struts 46 do not need to be so evenly spaced but simply that open flutes 48 are defined for the slurry to enter the pullhead/reamer 24 and the subsequently, the steel connect 28 and the pipe 30 during the pipehole directional drilling process.

Figure 6:
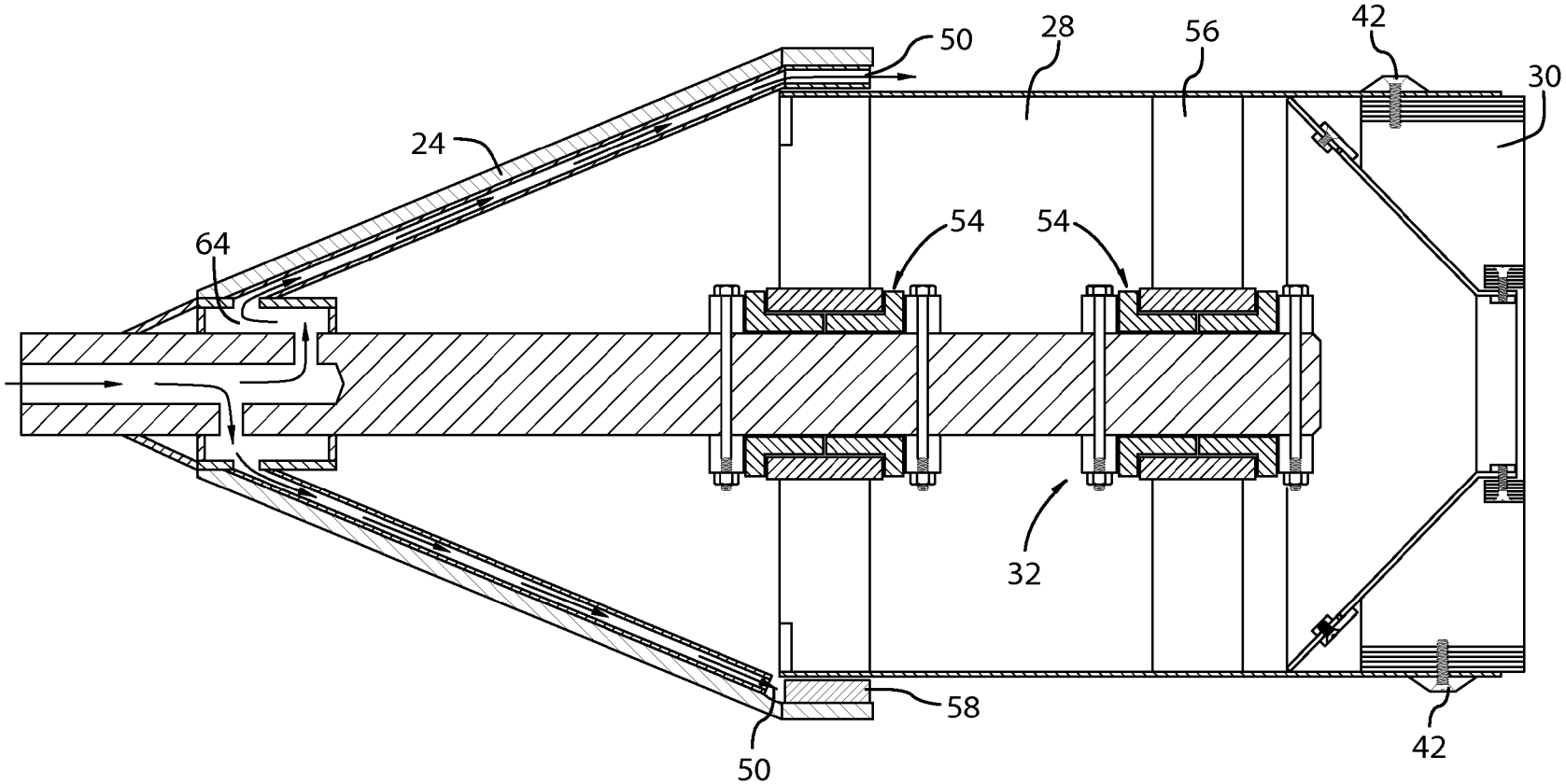
FIG. 6 is a more detailed view of how the directional drilling apparatus is attached.

Turning to FIG. 6, a detailed schematic of the connection between the pipe and the mandrel and pullhead/reamer is shown in cross-section. The pullhead/reamer 24 is screwed onto the end of the mandrel 18 after the drill bit has been removed. After the pullhead/reamer 24 has been attached, the steel connect 28 is then attached to the mandrel 18 via the bearing assembly 32 comprising a set of bearings 54 and associated supports 56. A set of TEFLON™ wear pads 58 are preferably placed between the inside of the pullhead/reamer 24 and the outside of the steel connect 28 in order to prevent the drilling fluid from re-entering the pullhead/reamer after it has been released by the jets 50 and to prevent wear and tear between the pullhead/reamer 24 and the steel connect 28 during the pipe hole directional drilling process since the pullhead/reamer 24 is rotating while the steel connect 28 is stationary (with respect to rotation). The bearings 54 are slotted over the mandrel 18 with their supports 56 fastened to the inside of the steel connect 28. The ends of the supports 56 which contact the inside of the steel connect 28 are preferably welded to the steel connect 28.

In this embodiment, the steel connect 28 is connected to the pipe 30 via the fastening means 42, seen as screws, in order to provide a sturdy connection between the steel connect 28 and the pipe 30. In most cases, since the integrity of the pipe is harmed by having a hole within (caused by the fastening means 42), when the pipe has been placed in the new hole, the end of the pipe 30 containing the hole is cut off to remove the holes caused by the screws.

In this figure, the slurry jets 50 may be more clearly seen. The bentonite is delivered from the reservoir, via the pump, down through the inside of the mandrel to a manifold 64 at the front of the pullhead/reamer 24 which then distributes the bentonite to the slurry jets 50. The flow of the bentonite is more clearly shown by arrows 66.

Figure 7:
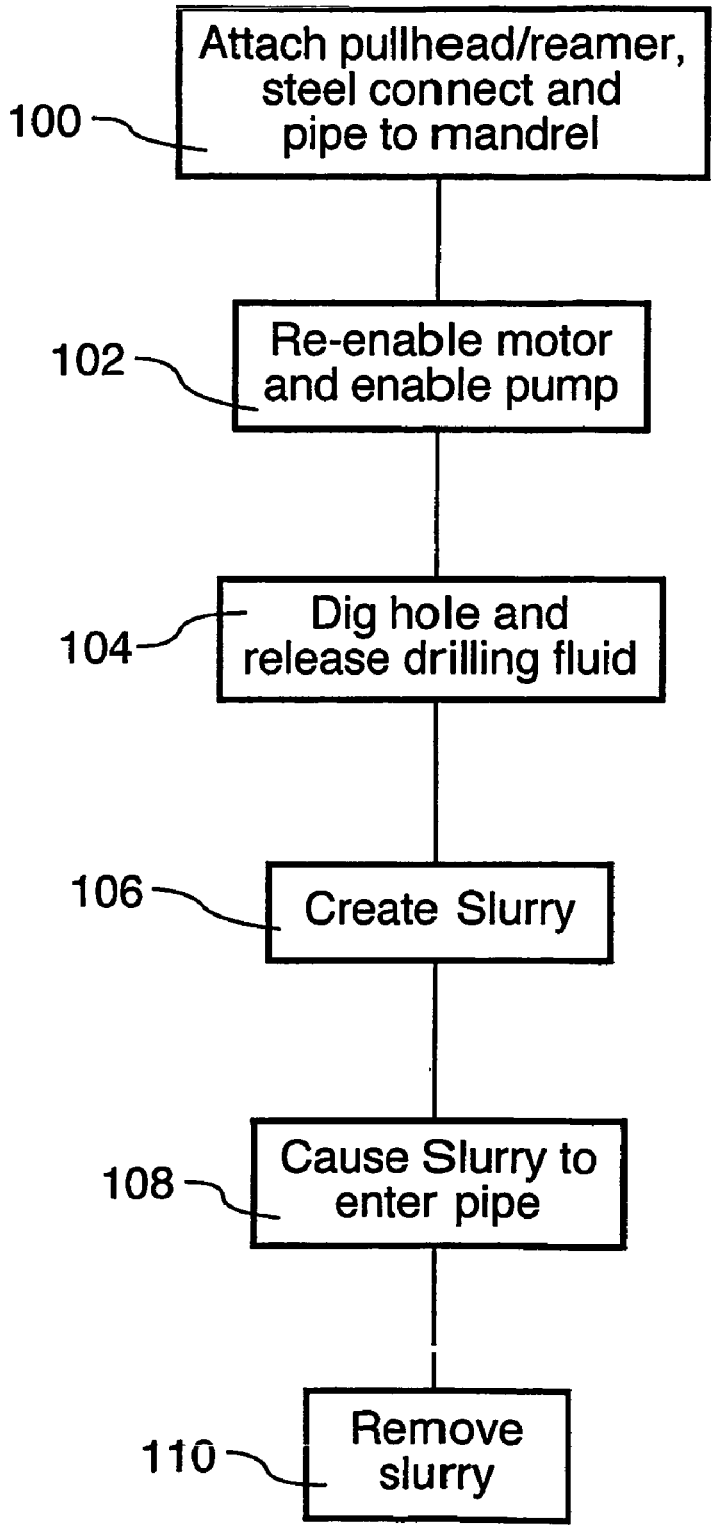
FIG. 7 is a flowchart illustrating a method of directional drilling in accordance with the present invention.

In operation, as shown in FIG. 7, for the pipe hole drilling process, after the pullhead/reamer 24, steel connect 28 and the pipe 30 have been attached to the mandrel 18 (step 100), the motor is re-enabled and the pump 34 enabled (step 102) which causes all of the apparatus to be slowly drawn towards the motor along the previously drilled guide hole. Since the pipe 30 is also attached to the mandrel 18, via the steel connect 28, as the pullhead/reamer 24 moves forward in the guide hole towards the motor, the pipe 30 is also pulled and travels along the hole towards the motor. As the apparatus travels along the guide hole, the motor causes the mandrel to rotate which, in turn causes the pullhead/reamer to rotate and for the digging of the pipe hole to begin (step 104). As described above, the pipe 30 and the steel connect 28 do not rotate. The connection between the steel connect 28 and the bearing assembly 32 assist in this manner since the bearing assembly 32 allows the mandrel to rotate within without causing the steel connect 28 to rotate. This provides further protection from any possible wear and tear between the outside of the pipe and the ground.

The pullhead/reamer 24 rotates around the stationary (with respect to rotation) steel connect 28 with the wear pads 58 absorbing the friction to reduce wear and tear on the steel connect 28 and the pullhead/reamer 24. As the apparatus is drawn back toward the motor 16, the rotation of the pullhead/reamer 16 causes the ground to be displaced since the set of teeth 52 located on the surface of pullhead/reamer 24 contacts the ground producing a hole having a diameter approximately equal to the diameter of the pullhead/reamer.

Once the motor has been re-enabled to begin the pipe hole drilling process, the pump 34 begins to operate to pump the drilling fluid 38 from the reservoir 36 to the slurry jets 50 via the mandrel 18 and the manifold 66. While the pipe hole is being drilled, the slurry jets 50 receive the drilling fluid, such as Bentonite, and releases it into the ground to interact with the displaced mud and form a slurry (step 106). The provision of the Bentonite reduces the chance of frac-outs by moisturizing the ground around the pipe hole direction drilling apparatus and lubricating the pipe. While the pullhead/reamer 24 is rotating, it causes the slurry to enter the pullhead/reamer 24 via the flutes 48 (such as indicated by arrows 49 listed on FIG. 4) located in its surface after which the slurry is then forced into the steel connect 28 and pipe 30 (step 108). In the preferred embodiment, the pump 34 and reservoir 36 are connected to the mandrel 18 through the motor 16. The pullhead/reamer maintains the hole in the ground by deflecting all of the mud and slurry away from the hole and to the flutes.

Pressure from the released bentonite by the slurry producing jets 50 also causes the slurry to enter the pipe 30 via the set of open flutes 48 defined by the struts 46. The constant pressure from the slurry created by the jets 52 causes the slurry within the pipe and to travel down the pipe 30 to the opposite end whereby the slurry may be collected and disposed by various means (step 110). In some cases, the collected slurry may be transported off-site. Alternatively, the bentonite, or drilling fluid, is recycled.

By causing the drilling fluid to drain through the inside of the pipe, via the open flutes 48 of the pullhead/reamer, allows for the circumference of the pullhead/reamer to be smaller than reamers used in prior art pipe hole directional drilling apparatus. In conventional directional drilling apparatus, to dig a 24 inch hole generally requires a 36 inch reamer. In the present invention, to dig a 24 inch hole requires a pullhead/reamer having a circumference of about 26 inches and preferably a single pass. Furthermore, in most prior art cases, to dig the 24 inch hole requires prior passes using a 16 inch reamer and a 24 inch reamer before using the 36 inch reamer to dig the final holes which totals at least three passes to dig a hole large enough to insert the pipe. Furthermore, with prior art processes, the hole must then be filled once the pipe has been inserted into the hole which require further time in completing the directional drilling process.

Although not shown, a smaller pipe may be placed inside the pipe 30 for receiving the slurry created by the mixing of ground and bentonite. In order to cause the slurry to enter the smaller pipe, a funnel may be placed within the steel connect 28 to guide the slurry towards the smaller pipe while the pipe 30 is being drawn by the motor. In this manner, the integrity of the inside of the pipe may be maintained so that the life of the pipe 30 may be extended. After the pipe hole drilling process is completed, the smaller pipe may be removed from the pipe.

Once the mandrel and pullhead/reamer have reached the original start of the guide hole, i.e. the first hole 10*a*, the pipe 30 is detached from the steel connect 28 and laid within the hole. The end of the pipe 30 may then be cut to remove the holes created by the fastening means 42 attaching the pipe 30 to the steel connect 28. The motor 16,m the pump 34, the reservoir 36 and the piping 40 are then moved to the next hole so that a new guide line may be dug and the process repeated. The end of the pipe 30 which was just laid down may then be attached with an end of the pipe to be laid down in the next hole using known processes.

It will be understood that the pipe does not have to be detached from the mandrel 18, the pullhead/reamer 24 and/or the steel connect 28 if the length of the pipe 30 is longer than the hole produced by the pipe hole directional drilling apparatus and is intended to be laid down in the subsequent hole as well.

Figure 8:
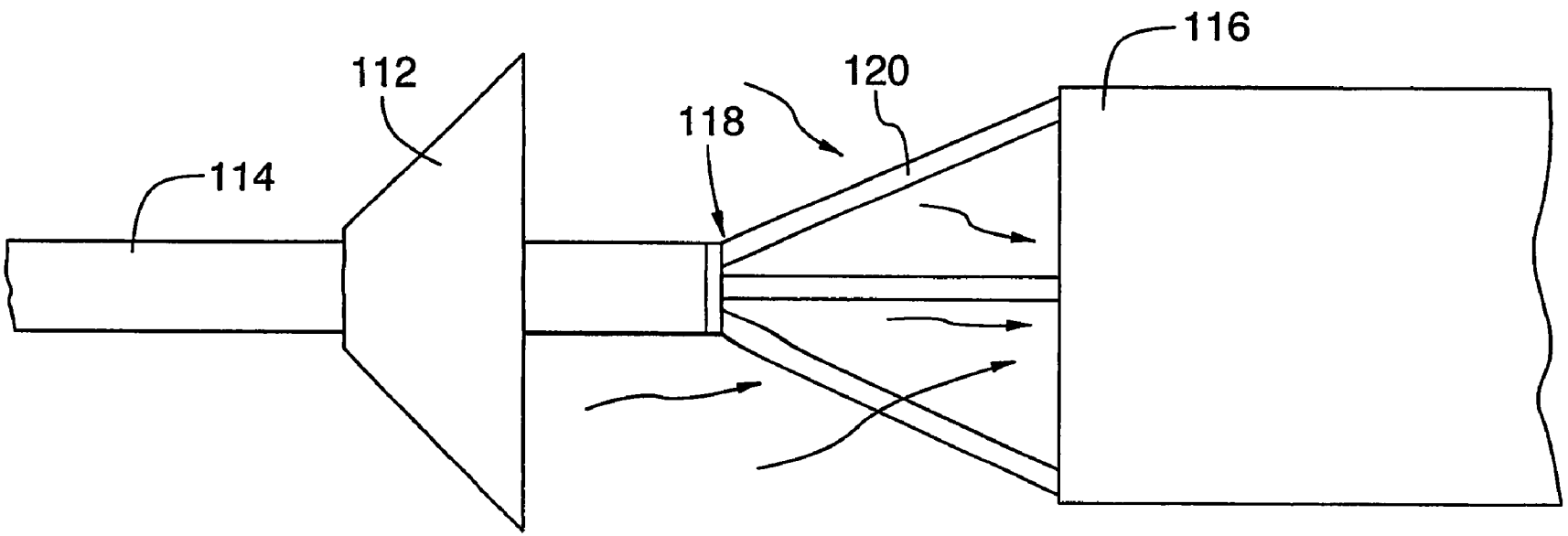
FIG. 8 is a schematic view of second embodiment apparatus for performing the method of the present invention.

In another embodiment of the present invention, as shown in FIG. 8, a reamer 112 is connected to a mandrel 114. A pipe 116 is then connected to the end of the mandrel 114 via known means such as a bearing assembly 118 comprising a set of support beams 120 which are connected to the inside of the pipe 116 to pull the pipe along as the hole is drilled. As the hole is being drilled, a drilling fluid, such as bentonite, is released from a set of jets 122 located on the surface of the reamer 112 to create a slurry between the mud and the bentonite. As the pipe 116 is being pulled, the slurry is then caused to enter the pipe 116. The pressure from the slurry entering the pipe causes the slurry to flow down the pipe in a direction opposite the direction of the reamer and pipe. The slurry may then be removed from the end of the pipe. As described above, by having the slurry travel inside the pipe, a smaller reamer may be used to produce a hole for the pipe to be inserted compared to processes in the prior art. In the prior art processes, larger holes were required so that the slurry may flow away from the hole being drilled along the outer surface of the pipe. Therefore the extra space was to protect frac-outs from occurring.

The method and apparatus of the present invention provides an advantage over the prior art such that the design allows the pullhead/reamer to rotate providing a secondary reamer action to the conventional reamer but eliminating the actual pullhead concept since conventional reamers are generally a closed sealed pullhead. The reamer/pullhead is designed with openings to the inside of the pipe allowing the slurry to flow internally through the pipe.

Further advantages for directional drilling apparatus are realized by the pullhead/reamer of the present invention. Firstly, frac outs are generally reduced or eliminated which assist in preserving nature and by protecting the environment from harmful chemicals. Secondly, the present invention allows for a reduced product hole (the size of the hole which is dug out in order to install the piping from 1.5 times the diameter of the pipe to a hole which is only slightly larger than the circumference of the piping. Also, the pullhead/reamer of the present invention may allow for a single pass operation in order to reduce the amount of time necessary to dig the holes to install the piping. Another advantage is that there is a greater opportunity to increase slurry/native conversion rate due to the fact that the slurry is controlled in the pipe head. Yet another advantage is that when the directional drilling is in operation for grade work, there is greater control of the pipe that is being installed. Finally, the present invention provides a better means for control of fluids which are being used during the directional drilling process in order to alleviate environmental concerns.

Another advantage of the present invention is that the process of performing directional drilling with the mud, via the slurry, being removed internally through the pipe rather than externally along the surface of the pipe allows for less passes to be required and smaller parts needed. This both saves time and money for the users.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A method of directional drilling to produce an underground hole for laying of a pipe comprising:

rotating a pullhead to displace mud to produce said underground hole;

mixing said mud with a drilling fluid to create a slurry; and guiding a portion of said slurry directly through the pullhead to an interior of said pipe causing said slurry to travel along said interior of said pipe to an opposite end of said pipe.

2. The method of claim 1 further comprising the step of removing said slurry from said opposite end of said pipe.

3. The method of claim 1 wherein said step of guiding comprises:

pressurizing said slurry to enter said pullhead; and funnelling said slurry directly towards said pipe.

4. The method of claim 1 wherein the step of mixing comprises:

releasing the drilling fluid; and directing the drilling fluid towards the mud.

5. The method of claim 1 wherein the step of rotating comprises:

attaching the pullhead, a steel connect and a pipe to a mandrel; and enabling a motor and a pump to rotate the pullhead.

* * * * *